US006220892B1

(12) United States Patent
Bishop

(10) Patent No.: US 6,220,892 B1
(45) Date of Patent: Apr. 24, 2001

(54) LOW PROFILE ELECTRICAL CONNECTORS FOR MICROPHONES

(75) Inventor: Peter G. Bishop, Isleham Ely (GB)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 09/354,402

(22) Filed: Jul. 15, 1999

(51) Int. Cl.[7] ..... H01R 3/00
(52) U.S. Cl. ..... 439/500; 439/60
(58) Field of Search ..... 439/500, 100, 439/350, 66, 356, 626; 310/324, 345, 348, 365, 366

(56) References Cited

U.S. PATENT DOCUMENTS

| | | | | |
|---|---|---|---|---|
| 4,420,706 | * | 12/1983 | Siebold et al. | 310/324 |
| 5,041,016 | | 8/1991 | Machado et al. . | |
| 5,830,007 | * | 11/1998 | Fry et al. | 439/500 |
| 5,980,268 | * | 11/1999 | Mischenko et al. | 439/66 |
| 6,077,089 | * | 6/2000 | Bishop et al. | 439/66 |

FOREIGN PATENT DOCUMENTS

| | | |
|---|---|---|
| 0346206A1 | 12/1989 | (EP) . |
| 0463487B1 | 6/1991 | (EP) . |

* cited by examiner

*Primary Examiner*—Khiem Nguyen
*Assistant Examiner*—Son V. Nguyen
(74) *Attorney, Agent, or Firm*—Dority & Manning, P.A.

(57) ABSTRACT

An electrical connector interconnecting a microphone to another conductive member includes an insulating body. The insulating body defines an internal receptacle having a shape for receipt of a microphone therein. An outer surface of the body is configured for disposition adjacent an conductive member, for example a circuit board, to which the microphone is to be electrically connected. A pair of connector elements are configured with the body. Each connector elements includes a first contact foot extending beyond the outer surface for electrical contact with the conductive member, and a second contact foot extending into the receptacle for electrical contact with the microphone. The receptacle generally encases at least a portion of the microphone for maintaining proper relative position between the microphone and insulating body to ensure electrical contact between the connector, microphone, and the conductive member.

25 Claims, 3 Drawing Sheets

LOW PROFILE ELECTRICAL CONNECTORS FOR MICROPHONES

BACKGROUND OF THE INVENTION

The present invention relates to electrical connectors in general, and more particularly to a low profile electrical connector used to interconnect a microphone to an adjacent electronic component, such as a circuit board, in a stacked configuration.

Prior art methods and devices are known for interconnecting electronic assemblies, particularly circuit boards and the like. Such methods and devices are also typically used to connect relatively small microphones to adjacent electronic components, particularly circuit boards.

With present-day electronic components, particularly assemblies used in cellular phones and the like, a concern with conventional methods and devices for interconnecting microphones to their respective associated electronic components is the limited space for such connections and assembled components. In order to reduce the overall size of the end product, it is desirable to vertically "stack" the components when possible. However, when the electronic components, including microphones, are arranged in a vertical or stacked arrangement, it is extremely difficult to solder or connect the terminals or connectors between adjacent components without bridging adjacent terminals with solder. Also, it is extremely difficult to maintain and ensure the correct relative position between the components both during the manufacturing process and in subsequent use of the end product. The soldering process is also a time consuming and difficult task.

Suggestions and improvements have been made in the art of electrical connectors, particularly connectors for use in a stacked configuration of circuit boards. For example, the European Patent Specification Publication No. 0463487 published on Jan. 2, 1992 and the PCT Application No. WO 97/02631 disclose types of electrical connectors for connecting adjacent stacked circuit boards. U.S. Pat. No. 5,041,016 and the European Patent Specification No. 0346206 also disclose other types of printed circuit board connectors. These prior art devices, however, are generally unsuited for connecting a microphone to an adjacent stacked electronic component.

The present invention provides an improved connector particularly suited for connecting a microphone and adjacent conductive member or electronic component in a stacked configuration.

OBJECTS AND SUMMARY OF THE INVENTION

It is therefore a principal object of the present invention to provide an improved electrical connector particularly suited for interconnecting a microphone to an adjacent conductive member or electronic component in a stacked configuration.

Still a further object of the present invention is to provide an electrical connector for interconnecting a microphone and adjacent component wherein the connector has a minimum height so as to interconnect the components in a stacked configuration with a minimal separation distance therebetween.

Additional objects and advantages of the invention will be set forth in part in the following description, or may be obvious from the description, or may be learned through practice of the invention.

In accordance with the objects and purposes of the invention, an electrical connector is provided for interconnecting a microphone to another conductive member or electronic component, for example a circuit board, in a stacked configuration. The connector includes an insulating body. The body defines an internal receptacle or space having a shape for receipt of a microphone therein. For example, in one preferred embodiment, the insulating body may comprise a generally cylindrical closed-end configuration having a top member at the closed-end and generally cylindrical side walls defining the microphone receptacle. It should be appreciated that the insulating body can have any manner of shape or configuration and still provide an internal receptacle for the microphone.

At least one electrical connector element is configured with the insulating body. For example, in the embodiment wherein the insulating body is a closed-end cylindrical component having a top member at the closed-end, the connector element is configured with the top member. The connector element has a first arm with a first contact foot defined thereon disposed relative to an outer or upper surface of the top member for mating contact with the adjacent conductive or electronic component, and a second arm extending through the top member with a second contact foot defined thereon for mating contact with a microphone. In this embodiment, the inner surface of the top member defines the upper boundary or limit of the microphone receptacle and the body is placed generally over the microphone so as to surround at least a portion of the microphone. In this manner, the second contact foot is pressed against a corresponding connection footprint defined on the microphone.

In a preferred embodiment, at least a pair of the connector elements are provided with the body member and spaced apart a distance corresponding to complementing connection footprints defined on the microphone and adjacent conductive member.

The connector elements can comprise any manner of configuration or shape. In a preferred embodiment, each of the connector elements comprises a generally U-shaped strip member having arm portions with the contact feet defined near the ends of the arm members. The closed-end of the U-shaped member wraps around and is fitted onto a respective leg member defined on the body. For example, the leg members may be defined in the top member and disposed across openings defined through the top member. In this manner, the U-shaped strip member is pressed onto the legs so that a first arm extends above the upper surface of the top member and the second arm extends below the lower surface of the top member and into the microphone receptacle. The arm members may be resilient arms so that electric contact is made between the contact feet and the microphone and conductive member, respectively, by pressure mating contact. In this manner, the arms move towards each other and into a space or opening so as to minimize the separation distance between the stacked components. In their compressed or conductive state, the connector elements lie essentially flush with the upper and lower surfaces of the top member with enough resiliency to maintain contact with the microphone and adjacent conductive member.

A principal concern of the present invention is to provide a connector having a minimal height or profile, as mentioned above. In this regard, a preferred embodiment of the microphone connector comprises a height or profile such that the microphone receptacle area has a height corresponding generally to that of the microphone. In this regard, the distance or vertical spacing between the microphone and its adjacent conductive member is essentially the thickness of the top member, particularly when resilient connector elements are utilized. It should be appreciated, however, that the profile height of the connector is not a limitation of the invention.

Another important concern in any connector is the attachment of the connector elements to the insulating body. In this regard, the present invention preferably includes a retention device configured between the leg member and the connector elements or strips. The retention device has a configuration so as to engage and retain the closed end of the connector elements around the leg while allowing the connector element to be initially slid onto the leg. In one preferred embodiment, this retention device comprises inclined surfaces disposed on either side of the leg adjacent to the connector element closed-end. The arms of the connector element slide up the inclined surfaces upon the connector element being pressed onto the leg. The arms then drop down once they have cleared the inclined surfaces and may include shoulders that abut against vertical end walls of the inclined surface. The inclined surfaces may be defined on inwardly disposed side wall projections that are adjacent to the leg. Thus, the connector element has a reduced width at the closed-end thereof that corresponds to the width between the facing side wall projections. The side walls may also define grooves in the body member that extend transversely from the leg. The connector element arms may reside at least partially within these grooves.

This configuration of a retention device provides for reliable securement of the connector elements to the base body yet results in a relatively simple procedure for pressing the connector elements onto the body. The closed-end of the connector elements is pushed onto the leg wherein at least one of the arms of the connector element slides up inclined surfaces of the retention device until the shoulder portions thereof clear the inclined surface. At this point, the shoulder portions drop into the groove and abut against vertical walls of the inclined surfaces. The reduced width closed-end portion of the connector element then fits securely between the side walls that define the inclined surfaces and wraps around the leg member.

The invention will be described in greater detail below through preferred embodiments as illustrated in the attached Figures.

DETAILED DESCRIPTION

Figure 1A:
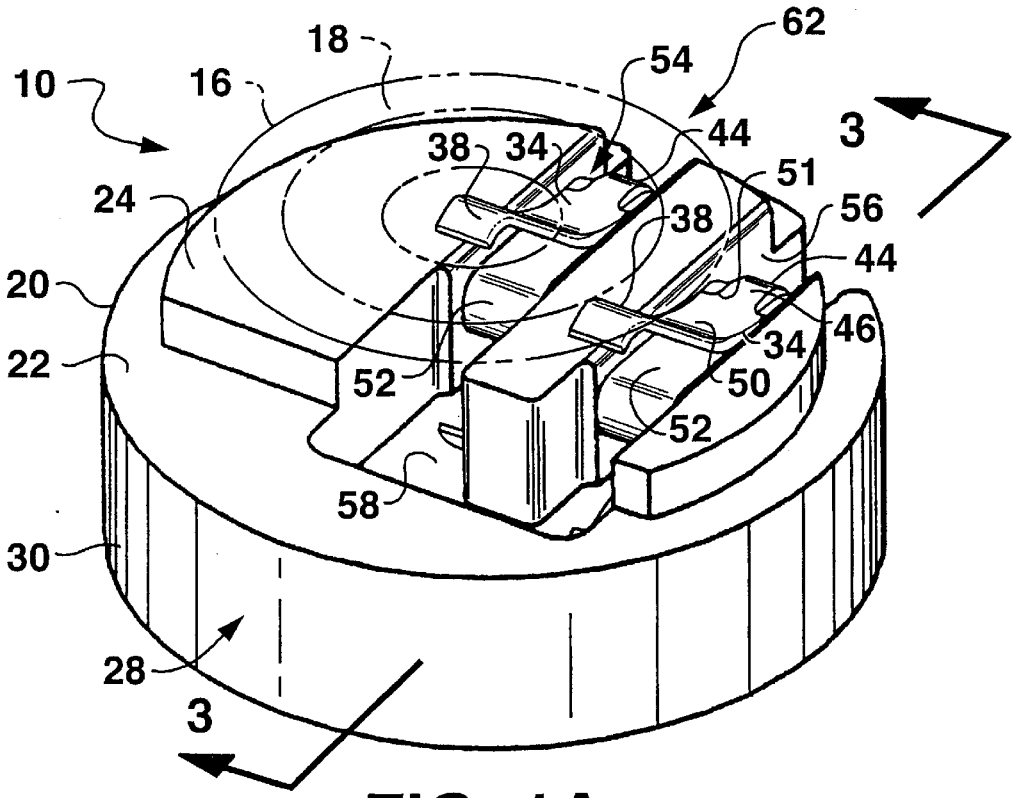
FIG. 1A is a top perspective view of a microphone connector according to the present invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used in another embodiment to yield still a further embodiment. It is intended that the present invention include such modifications and variations.

Figure 1B:
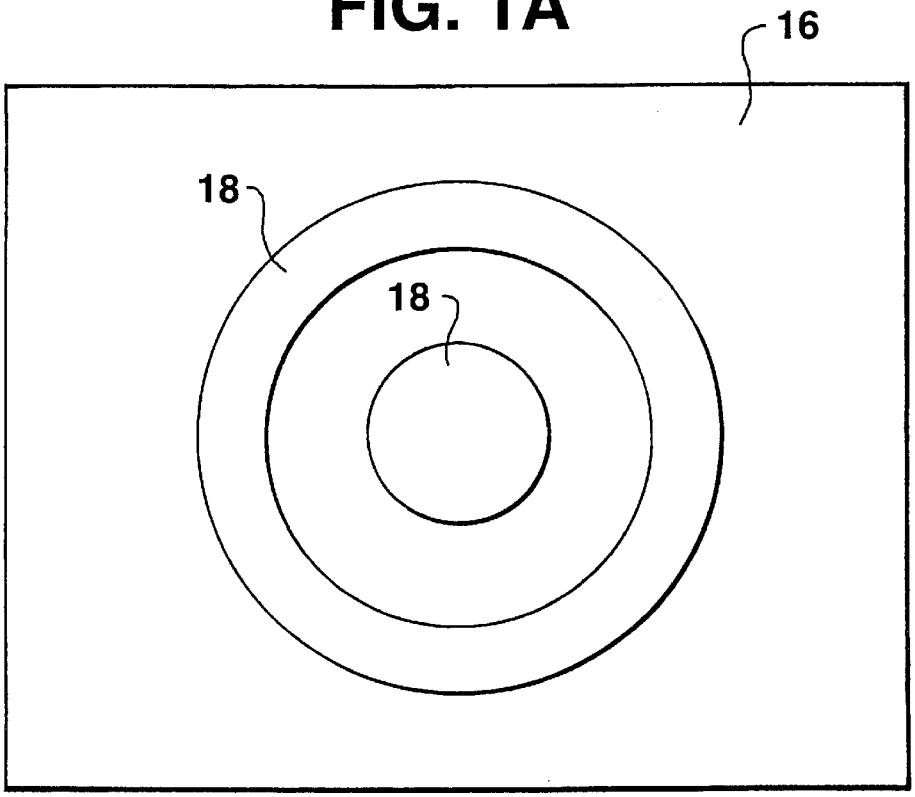
FIG. 1B is a top view of a conductive member, particularly a circuit board, having an electrical footprint defined thereon that is to be mated to the connector of FIG. 1A.

Electrical connector 10 is illustrated generally in the figures. Connector 10 is particularly suited for interconnecting a microphone 12, to a vertically stacked adjacent conductive member, such as a circuit board 16. Referring to FIG. 1B, circuit board 16 comprises an electrical footprint defined thereon. In this instance, the footprint is defined as concentric contact circles 18. Each of circles 18 will mate with an electrical connector element of connector 10, as described in greater detail below. Likewise, microphone 12 illustrated in FIG. 2B also contains a contact footprint defined thereon in the configuration of concentric circles 14. Contact circles 14 will mate with opposite ends of the connector elements of connector 10, as described below.

Connector 10 includes an insulating body, generally 20. Body 20 defines an internal receptacle 28 having a shape and size for receipt of microphone 12 therein. For example, referring to FIGS. 2A and 2B, body 20 has a generally round configuration and receptacle 28 is defined by a cylindrical wall 30. Cylindrical wall 30 has a depth so as generally to encase the circumference of the round microphone 12. The height of cylindrical wall 30 is also generally about the same as the height of microphone 12 so that connector 10 does not unnecessarily add to the vertical stacked height of the components. It should be appreciated that the shape or configuration of insulating body 12 is not a limiting feature of the invention. For example, if the microphone is rectangular, square, etc., then insulating body 20 may take on a corresponding shape and define a correspondingly configured receptacle 28.

Figure 3:
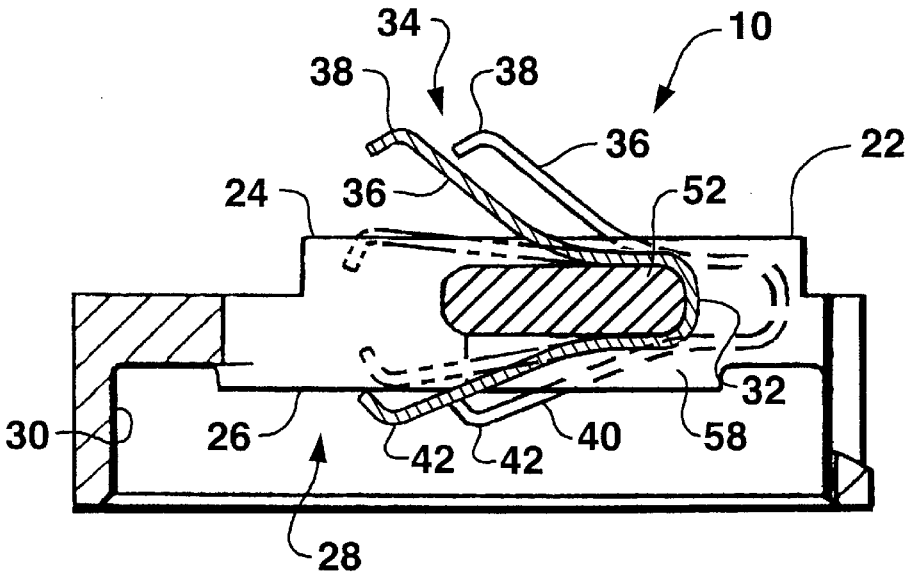
FIG. 3 is a side cross-sectional view of the connector shown in FIG. 1A taken along the lines indicated.

Insulating body 20 may be defined by a top member 22. In the embodiment illustrated in the figures wherein insulating body 20 is defined as a generally closed-end cylindrical member, top member 22 defines the closed-end of cylindrical wall 30. Top member 22 has an outer surface 24 against which the conductive member or circuit board 16 is to be disposed. Likewise, top member 22 includes an inner surface 26, particularly seen in FIGS. 3 and 4. Inner surface 26 generally defines the upper boundary of microphone receptacle 28 and is the surface against which microphone 12 is to be disposed against in the electrically mated configuration of the component.

Connector 10 also includes at least one connector element, generally 34. A number of connector elements 34 may be used corresponding to the footprint of the electronic components to be connected. For example, referring to FIGS. 1B and 2B, concentric footprints 18 of circuit board 16 must be connected to concentric footprints 14 of microphone 12. Accordingly, connector 10 includes two connector elements 34 offset a distance corresponding to the offset of footprints 18,14. Connector elements 14 are preferably formed from a conductive strip material and are configured in a closed-end with extending arm configuration. For example, connector elements 34 may have a U-shape, V-shape, etc.

Referring to the figures, connector elements 34 have a closed-end 44 and a first upper arm 36 and second lower arm 40 extending therefrom. A contact foot 38 is defined on first arm 36 and a contact foot 42 is defined on second arm 40. In the illustrated embodiment, the contact feet are defined by turned or bent portions of the arms. It should be appreciated that the contact feet can be defined by any appropriate configuration. For example, the contact feet may be defined by the extreme edge portions of arms 36,40 in an embodiment wherein the contact arms are bent so that their extreme edge is outwardly facing. It should also be appreciated that the contact feet may be defined differently on each of the upper and lower arms 36, 40. It should also be appreciated that it is not a requirement of the invention that each of the contact arms 36, 40 comprise resilient pressure mount arms. For example, the lower contact arm 40 may comprise a generally rigid arm that is configured for direct surface mounting against the corresponding footprint of microphone 12. Likewise, upper arm 36 may be configured as a generally rigid arm configured for surface mounting against conductive member 16.

Body member 20 preferably includes leg members 52 configured therein for each connector element 34. Leg member 52 may be, for example, a transversely extending member co-molded with body member 20. Leg 52 preferably extends across an opening 58 defined through top member 22. In this manner, referring particularly to FIG. 3, closed-end 32 of connector element 34 is pushed onto leg member 52 from the side of insulating body 20. Lower arm 40 extends through opening 58 and into microphone receptacle 28. Upper arm 36 extends above outer surface 24 of top member 22. Leg members 52 may be defined between side walls 56. Side walls 56 also define connector element grooves or spaces corresponding generally to the width of the connector elements, the grooves 54 also define a space into which the connector element arms flex in the embodiment wherein arms 36, 40 are resilient contact arms.

Figure 2A:
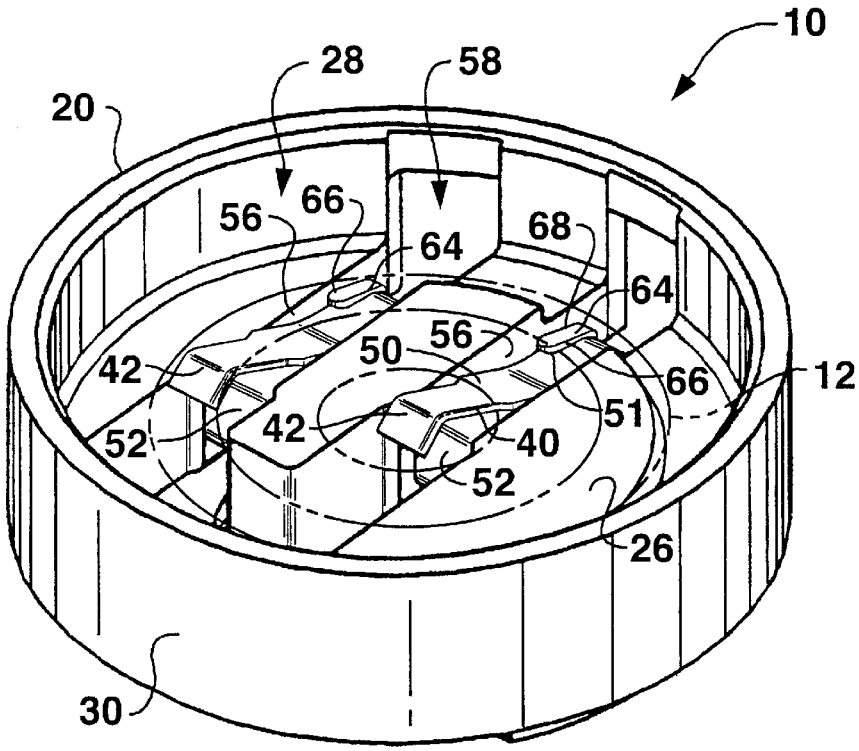
FIG. 2A is a bottom perspective view of the microphone connector shown in FIG. 1A.
Figure 2B:
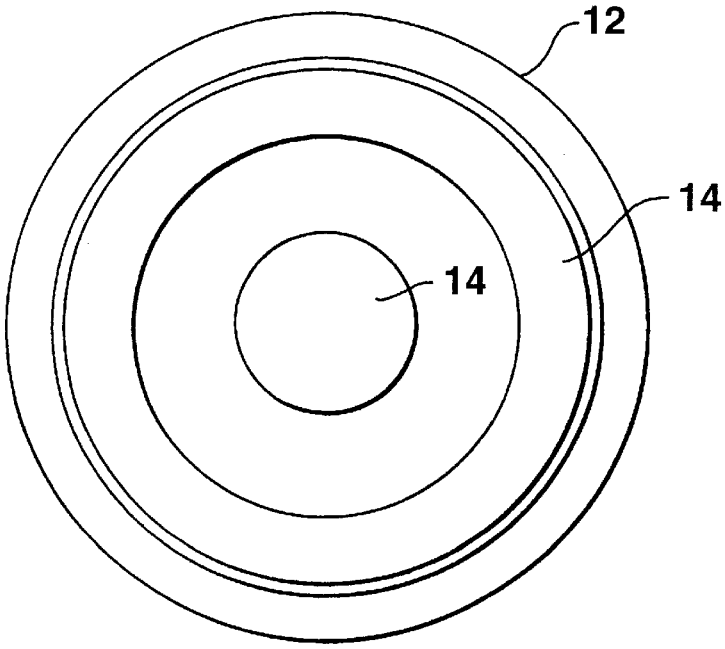
FIG. 2B is a top view of a microphone that is to be mated with the connector of FIG. 2A.

It is also an important consideration that a device or mechanism be supplied for ensuring that connector elements 34 are retained on body 20, and particularly on leg members 52. In this regard, a retention device, generally 62, is provided. Retention device 62 may comprise a system of engaging surfaces between connector elements 34 and the end or edge of leg members 52. For example, in one embodiment of cooperating engaging surfaces between body 20 and connector elements 34, as illustrated in the figures and particularly seen in FIG. 2a, inclined surfaces 64 are defined adjacent the end of legs 52 where closed-ends 32 of connector elements 34 wrap around legs 52. Inclined surfaces 66 may be defined, for example, on inwardly projecting segments 68 defined on side walls 56. Inwardly projecting segments 68 include an end wall 66 defined thereon. Inwardly projecting segments 68 may be defined on the bottom of top member 22, as illustrated in FIG. 2a, or alternatively on the top surface thereof. It may also be preferred to define the segments on both the top and bottom surfaces. A reduced width section is defined between inwardly projecting segments 68 and connector elements 34 thus have a correspondingly reduced width section 46 generally defining closed-end 32. Connector elements 34 have an increased width section 50 having a width generally corresponding to that between side walls 56. A shoulder 52 is defined between the increased width section 50 and reduced width section 46.

With the structure of the retention device described herein, it is a relatively simple process to press connector elements 34 onto body 20, and particularly onto leg member 52. The closed-end 32 of connector elements 34 is pressed onto the end of leg 52 such that the increased width sections 50 initially slide up inclined surfaces 64. As connector elements 34 are pushed progressively onto leg 52, the increased width sections 50 slide past the inwardly projecting segments 68 and drop into the increased width section of grooves 54 defined between side walls 56. The reduced width section 46 provided at the closed-end 32 of the connector elements 34 falls between the inwardly projecting segments 68. Shoulders 51 of connector elements 34 slide down end walls 66 of inwardly projecting segments 68. The applicants have found that this embodiment of a retention device securely and firmly holds connector elements 34 to insulating body 20 without the use of any additional or external attaching devices, molding processes, or the like.

The retention device is also described in detail in our co-pending U.S. Patent Application entitled "Low Profile Electrical Connector" filed on the same day as the present application and claiming priority as a continuation-in-part application from U.S. application Ser. No. 09/232,999 filed on Jan. 19, 1999. Both of these applications are incorporated herein in their entirety for all purposes.

Figure 4:
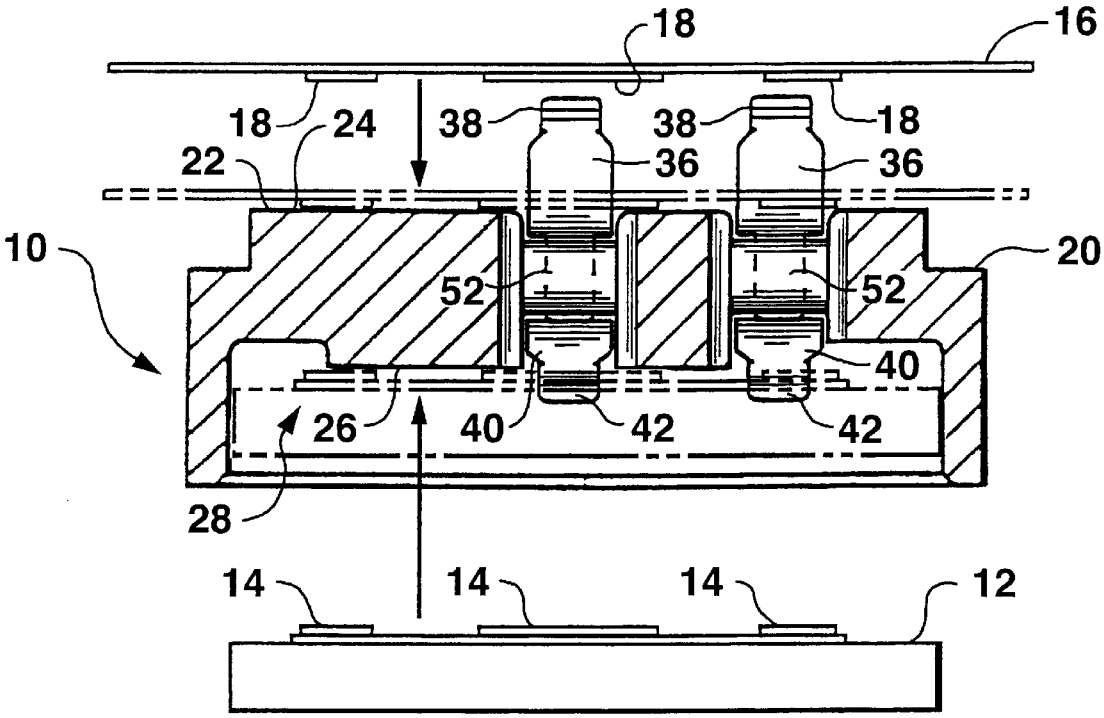
FIG. 4 is a cross-sectional operational view of the microphone connector according to the invention particularly illustrating the connector being mated between the conductive circuit board member and microphone.

FIG. 4 illustrates connector 10 in an operational view as it would be used to electrically connect a circuit board 16 and microphone 12. Microphone 12 is inserted into receptacle 28 such that footprints 14 mate with contact feet 42 of resilient arms 40. The mated configuration is illustrated in dashed lines in the figure. It can be seen that microphone 12 resides completely within receptacle 28 and resilient arms 40 move into the grooves or spaces defined between side walls 56 such that the upper surface of microphone 12 is directly adjacent to inner surface 26 of top member 22. Similarly, circuit board 16 is pressed down against contact feet 38 of resilient arms 36 so as to be disposed directly against outer surface 24 of top member 22. Accordingly, in the stacked electrically connected configuration of the components, a minimal separation distance is needed between the components and the connectors are held securely on the corresponding footprints of microphone 12 and circuit board 16.

It should be appreciated by those skilled in the art that various modifications and variations can be made in the present invention without departing from the scope and spirit of the invention. For example, insulating body 20 may take on any manner of configuration and still define and appropriate receptacle for microphone 12. Likewise, connector element 34 can have various configurations, including relatively rigid surface mount connector arms, alternate contact feet configurations, etc. It is intended that the present invention include such modifications and variations as come within the scope and spirit of the appended claims and their equivalents.

What is claimed:

1. An electrical connector for interconnecting a microphone to another conductive member, including a circuit board, in a stacked configuration, said connector comprising:

an insulating body, said body defining an internal receptacle with a continuous circular side wall having a cylindrical shape adapted for receipt of the microphone therein, said insulative body further comprising an inner surface and an outer surface configured for disposition adjacent a conductive member to which the microphone is to be electronically connected; and first and second connector elements configured with said body, each said connector element having U-shape strip members, the U-shaped strip having a first contact toot extending beyond said outer surface for electrical contact with the conductive member, and a second contact foot extending into said receptacle for electrical contact with the microphone, further wherein the U-shaped strip members comprise arm portions with said contact feet defined at opposite ends thereof, and a closed end wrapping around and fitted onto a respective lea member configured in said body; and wherein said receptacle encases at least a portion of the microphone for maintaining contact between the microphone and said body to ensure electrical conductivity between the connector elements and the microphone.

2. The microphone connector as in claim 1, wherein said body comprises a top member defining an upper boundary of said receptacle at a first side thereof, and defining said outer surface at a second side thereof, said top member having openings defined therethrough with said leg members disposed proximate said openings such that said arm portions with said second contact foot extend through said openings into said receptacle.

3. The microphone connector as in claim 2, wherein said body comprises a cylindrical shape with said top member defining a closed-end of said cylindrical shape, said cylindrical shaped body further comprising a cylindrical wall defining said receptacle.

4. The microphone connector as in claim 1, wherein said connector elements are spaced apart a distance corresponding to a connection footprint defined on the microphone and connector element.

5. The microphone connector as in claim 1, wherein said first and second connector elements comprise bent strip members and oppositely facing arms, said contact feet defined on said arms, said connector elements pressed onto leg members defined on said body within grooves, said grooves having side walls bounding said connector elements.

6. The microphone connector as in claim 1, wherein said first and second connector elements comprise bent strip members and oppositely facing arms, said contact feet defined on said arms, at least one of said arms extending at an angle from said closed-end and being resilient for pressure contact mounting with a microphone or conductive member.

7. The microphone connector as in claim 6, wherein said first and second connector elements are pressed onto leg members defined on said body, and further comprising a space in said body adjacent said leg members into which said arms move when said connector is operationally connected between a microphone and conductive member.

8. The microphone connector as in claim 1, wherein said first and second connector elements comprise bent strip members with oppositely facing arms with said contact feet defined adjacent to ends of said arms, at least one of said arms extending at an angle and being resilient for pressure contact mounting with a microphone or conductive member, said closed-end of said connector elements fitted around a respective leg member configured in said body, and further comprising a retention device configured with said leg member and having a configuration so as to engage and retain said closed-end of said connector element around said leg while allowing said connector element to be slid onto said leg member.

9. The microphone connector as in claim 8, wherein said retention device comprises inclined surfaces disposed on either side of said leg member adjacent to said connector element closed-ends, at least an upper said arm of said connector element sliding up said inclined surfaces upon pressing said connector element onto said leg member.

10. The microphone connector as claim 9, wherein said connector elements are disposed at least partially within grooves defined in said body, said grooves defined between facing side walls that extend transversely from said leg.

11. The microphone connector as in claim 10, wherein each said inclined surface terminates in a vertical end wall.

12. The microphone connector as in claim 11, wherein said inclined surfaces are defined on inwardly projecting segments.

13. An electrical microphone connector for interconnecting a microphone to a conductive member, including a circuit board, in a stacked configuration, said connector comprising:

an insulating body, said body comprising an elongated closed-end configuration having a top member at said closed-end;

at least one U-shaped pair of connector elements comprising first and second electrical connector elements configured with said top member, said first connector element comprising a first arm with a first contact toot defined thereon disposed relative to an outer plane of said top member for mating contact with the conductive member, and a second arm extending through said top member with a second contact foot defined thereon relative to an inner plane of said top member for mating contact with a microphone, the top member defining a closed-end of said configuration, whereby said first connector element and said second connector element are spaced apart a distance corresponding to connection footprints defined on the microphone and conductive member, the closed end wrapping around and fitted onto a respective leg member in said body; and said body defining a microphone receptacle within said elongated closed-end configuration, said receptacle comprising a continuous circular side wall having a continuous cylindrical shape, such that said body can be placed over and surround the microphone with said second contact foot being pressed against a corresponding connection footprint defined on the microphone.

14. The microphone connector as in claim 13, wherein said connector element comprises a generally U-shaped strip member.

15. The microphone connector as in claim 13, wherein said connector element is pressed onto a leg member defined on said body, said leg member disposed across an opening in said top member through which said second arm passes.

16. The microphone connector as in claim 15, further comprising first and second connector elements, each said connector element pressed onto a respective said leg member disposed across a respective said opening.

17. The microphone connector as in claim 16, wherein said leg members are disposed within grooves defined in said top member, said grooves having side walls bounding said connector element first and second arms.

18. The microphone connector as in claim 15, wherein said first and second arms of said first and second connector element are resilient arms and extend at an angle from said top member for pressure contact mounting with the microphone and conductive member.

19. The microphone connector as in claim 13, wherein said connector elements comprise strip members bent into a closed-end with said arms extending from said closed-end, said closed-end of said connector element fitted around a leg member configured in said body member, and further comprising a retention device configured with said leg member and having a configuration so as to engage and retain said closed-end of said connector element around said leg member while allowing said connector element to be slid onto said leg member.

20. The microphone connector as in claim 19, wherein said retention device comprises inclined surfaces disposed on either side of said leg adjacent to said connector element closed-end, at least said first arm of said connector element sliding up said inclined surfaces upon pressing said connector element onto said leg member.

21. The microphone connector as claim 20, wherein said connector elements are disposed at least partially within grooves defined in said body, said grooves defined between facing side walls that extend transversely from said leg member, said inclined surfaces defined on said side walls adjacent said leg member.

22. The microphone connector as in claim 21, wherein each said inclined surface terminates in a generally vertical end wall, said first and second connector elements comprising shoulders abutting said generally vertical end walls.

23. The microphone connector as in claim 22, wherein said inclined surfaces are defined on inwardly projecting segments of said side walls adjacent to said leg member.

24. An electrical connector for interconnecting a microphone to another conductive member, including a circuit board, in a stacked configuration, said connector comprising:

an insulating body, said body defining an internal receptacle with a side wall(s) having a substantially cylindrical shape adapted for receipt of the microphone, said insulative body further comprising an inner surface and an outer surface configured for disposition adjacent a conductive member to which the microphone is to be electronically connected; and first and second connector elements configured with said body, each said connector element having U-shape strip members, the U-shaped strip members having a first contact foot extending beyond said outer surface for electrical contact with the conductive member, and a second contact foot extending into said receptacle for electrical contact with the microphone, further wherein the U-shaped strip members comprise arm portions with said contact feet defined at opposite ends thereof, and a closed end wrapping around and fitted onto a respective leg member configured in said body; and wherein said receptacle encases at least a portion of the microphone for maintaining contact between the microphone and said body to ensure electrical conductivity between the connector elements and the microphone.

25. An electrical connector for interconnecting a microphone to another conductive member, said connector comprising:

an insulating body, said body defining an internal receptacle having a substantially circular shape adapted for receipt of the microphone, said insulative body further comprising an inner surface and an outer surface configured for disposition adjacent a conductive member to which the microphone is to be electronically connected; and first and second connector elements configured with said body, each said connector element having U-shape strip members, the U-shaped strip members having a first contact foot extending beyond said outer surface for electrical contact with the conductive member, and a second contact foot extending into said receptacle for electrical contact with the microphone, further wherein the U-shaped strip members comprise arm portions with said contact feet defined at opposite ends thereof, and a closed end wrapping around and fitted onto a respective leg member configured in said body; and wherein said receptacle encases at least a portion of the microphone for maintaining contact between the microphone and said body to ensure electrical conductivity between the connector elements and the microphone.

* * * * *

UNITED STATES PATENT AND TRADEMARK OFFICE

CERTIFICATE OF CORRECTION

PATENT NO. : 6,220,892 B1
DATED : April 24, 2001
INVENTOR(S) : Peter G. Bishop

It is certified that error appears in the above-identified patent and that said Letters Patent is hereby corrected as shown below:

Column 6,
Line 63, change “toot” to -- foot --;

Column 7,
Line 3, change “lea” to -- leg --;

Column 8,
Line 18, change “toot” to -- foot --.

Signed and Sealed this

Fourth Day of March, 2003

JAMES E. ROGAN
*Director of the United States Patent and Trademark Office*